US005690171A

United States Patent [19]

Winch et al.

[11] Patent Number: 5,690,171

[45] Date of Patent: Nov. 25, 1997

[54] WELLBORE STIMULATION AND COMPLETION

[76] Inventors: Peter Clive Winch, 1371 Waterworks Road, The Gap, Queensland 4061; Ian Gray, 32 Norman Street, Coorparoo, Queensland 4151, both of Australia

[21] Appl. No.: 531,092

[22] Filed: Sep. 20, 1995

[30] Foreign Application Priority Data

Sep. 20, 1994 [AU] Australia ..... PM8257

[51] Int. Cl.[6] ..... E21B 43/263

[52] U.S. Cl. ..... 166/63; 166/299

[58] Field of Search ..... 166/63, 299, 297, 166/311; 102/305, 306, 310

[56] References Cited

U.S. PATENT DOCUMENTS

| | | | |
|---|---|---|---|
| 3,026,939 | 3/1962 | Sweetman | 166/63 X |
| 3,029,732 | 4/1962 | Greene | 166/63 X |
| 3,422,760 | 1/1969 | Mohaupt | 102/21.6 |
| 3,620,314 | 11/1971 | Bohn | 175/4.59 |
| 4,064,935 | 12/1977 | Mohaupt | 166/63 |
| 4,081,031 | 3/1978 | Mohaupt | 166/299 |
| 4,140,188 | 2/1979 | Vann | 166/63 X |
| 4,530,396 | 7/1985 | Mohaupt | 166/63 |
| 4,612,992 | 9/1986 | Vann et al. | 166/297 |
| 4,673,039 | 6/1987 | Mohaupt | 166/281 |
| 4,790,385 | 12/1988 | McClure et al. | 166/299 |
| 4,976,318 | 12/1990 | Mohaupt | 166/311 |
| 5,005,641 | 4/1991 | Mohaupt | 166/63 |
| 5,046,567 | 9/1991 | Aitken et al. | 166/63 X |

OTHER PUBLICATIONS

"Fracturing Aspects of Horizontal Wells," Soliman, et al., *JPT*, Aug. 1990.

"Matrix Stimulation Method for Horizontal Wells," Economides, et al., *JPT*, Jul. 1991.

"Horizontal Drilling Is Becoming Commonplace".

*Primary Examiner*—Frank Tsay

*Attorney, Agent, or Firm*—Sidley & Austin

[57] ABSTRACT

A method and device for stimulating and completing a drilled wellbore in a productive formation. The device comprises a pipe having a plurality of weakened portions and containing a propellant material. When the propellant is ignited it produces rapidly expanding gaseous combustion products which puncture the weakened portions of the pipe. The expanding gas fractures the surrounding formation thereby stimulating the formation to production. The pipe remains in the wellbore and is used for collecting oil and gas from the formation.

14 Claims, 8 Drawing Sheets

WELLBORE STIMULATION AND COMPLETION

TECHNICAL FIELD OF THE INVENTION

This invention relates to a device and method for the stimulation and completion of wellbores. In particular, it relates to the extraction or injection through a conduit of formation fluids, usually oil or gas, from or into subterranean formations.

BACKGROUND OF THE INVENTION

Conventional wellbore stimulation and completion techniques require the drilling of the wellbore followed by cementing of a casing string in the wellbore to isolate the productive interval. The casing and cement sheath are then perforated to allow extraction of the formation fluid into the conduit formed by the casing.

Early perforation methods included bullet guns that fired a slug through the casing and sheath. Shaped charge guns were introduced in the 1940's. The shaped charges were more effective than the previous methods since they could be constructed to direct energy towards the formation thus producing a greater penetration into the formation than earlier techniques.

The development of well completion technology is discussed in U.S. Pat. No. 4,673,039 granted to Mohaupt. Mohaupt describes a casing string having incipient perforations. The casing string is designed so that the incipient perforations will be adjacent the productive formation once the casing string is run into the well. The casing string is inserted to the wellbore with the incipient perforations closed and cemented in place.

After the cement has set the perforations are opened, such as by removing a sleeve. In another form the perforations re opened concurrently with the fracturing of the cement sheath and surrounding formation. This can be done using a propellant charge that releases large quantities of high pressure gaseous combustion products.

Although the Mohaupt approach offers an advantage over the prior art it nonetheless requires a number of separate actions to be performed. Firstly the well is drilled. Next a perforated casing with an imperforate sleeve is run into the bore. The casing is then cemented in place using more or less conventional techniques. The sleeve is then removed to open the perforations in the case. A gas fracturing tool is then run into the casing and detonated to fracture the cement sheath and surrounding formation. Mohaupt discloses U.S. Pat. Nos. 3,422,760, 4,064,935, 4,081,031 and 4,530,396, all of which describe suitable fracturing tools.

It would be preferable if the majority of these tasks could be performed in a single action.

Modern drilling techniques have been developed for horizontal drilling which allow an extended section of the wellbore (sometimes as much as two kilometers or more) to collect fluid from the productive part of a formation. Horizontal drilling presents a number of technical problems relating to setback distance (the required distance from the target needed to enter the productive formation horizontal), kickoff point (the point in the vertical section where deviation commences) and approach phase (where the wellbore angle is adjusted to intersect the productive formation at the desired angle). These problems have been substantially overcome using modern drilling technology. Reference may be had to an article titled "Horizontal Drilling is Becoming Commonplace: Here's How It's Done" commencing on page 35 of the March 1989 issue of *World Oil*.

The technique of Mohaupt is not able to take maximum advantage of horizontal drilling technology. As described, it involves running the propellant which is contained in a sheath, into the casing by a separate action. The system disclosed used a wireline system which is not suitable for pushing around bends or in horizontal sections. In addition, the requirement to run a separate sheath containing the propellant involves substantial force to push it down and along the pipe. Such a sheath must have significant mechanical strength. As a result it reduces the proportion of propellant available in any section of pipe. It also imposes a need for substantial pull-out capability following stimulation.

Stimulation and completion of the wellbore over the entire length of the horizontal section is preferable.

OBJECT OF THE INVENTION

It is an object of the present invention to provide a method and apparatus for well stimulation and completion that is simpler, quicker and more efficient than prior art techniques.

It is a further object of the invention to provide a method and apparatus for the stimulation and completion of a well that is suited to horizontal or deviated wells.

DISCLOSURE OF THE INVENTION

In one form, although it need not be the only or indeed the broadest form, the invention resides in a device for the stimulation and completion of a wellbore in a subterranean formation comprising: a pipe having a plurality of weakened portions penetratable to leave apertures in the pipe; a propellant material contained within the pipe, said propellant material producing expanding gaseous combustion products when ignited, for penetrating the weakened portions of the pipe; and one or more igniter means in the pipe for igniting the propellant material; said pipe being suitable, after combustion, for enabling fluid to be pumped into or from the wellbore.

The pipe may be made of any suitable material, such as metal or plastic of correct strength and thickness to remain flexible enough to enable insertion into deviated wells but not be damaged by high pressures produced during combustion of the propellant material.

The weakened portions may suitably comprise an aperture or slot in the pipe covered by a sealing matrix. The matrix preferably comprises a wire mesh and filler. The filler is removable by the high pressure gaseous combustion products but the wire mesh remains over the apertures. The wire mesh is suitably of an appropriate structure to permit easy passage of fluid but to resist ingress to the pipe of non-fluid material from the formation. By non-fluid material is meant principally coal, rock or dirt.

The pipe is preferably suitable for the collection of fluid such as oil and gas. Components within the pipe for the support and ignition of propellant material may be consumable during the combustion of the propellant material or may be removable from the pipe after combustion of the propellant material.

The propellant material may be a solid or liquid propellant. If a solid propellant is used it can either be loaded as separate grains into the pipe or cast on the inside surface of the pipe. A liquid propellant can be pumped into the pipe after the pipe is run into the wellbore.

The igniter means may be either a single continuous high rate burning material such as detonating cord, electrically initiated pyrotechnic igniters, a combination of both or laser ignition via optical fibres.

In the case of electrical initiation, the igniter means preferably comprises an igniter case containing a pyrotechnic material and one or more initiators.

The device is suitably formed in a number of lengths which are joined together as they are inserted into the wellbore. The lengths may suitably be joined by threaded sections which incorporate sealing means.

In a further form, although again not necessarily the broadest form, the invention resides in a method of stimulating and completing a wellbore including the steps of: positioning a pipe having weakened portions and containing propellant material in a wellbore in a productive formation; igniting the propellant material in said pipe to produce expanding gaseous combustion products to cause a perforation of the pipes at the weakened portions and fracturing of the surrounding formation; and collecting formation fluid from the formation through the pipe wherein the fluid enters the pipe through the perforated weakened portions.

The step of positioning a pipe in a productive formation may further include the steps of placing solid propellant material and igniter means within the pipe and running the pipe into the wellbore until the pipe is in the productive formation.

Alternatively, the step of positioning a pipe in a productive formation may further include the steps of running the pipe into the wellbore until the pipe is in the productive formation, placing igniter means in the pipe and pumping liquid propellant material into the pipe. The igniter means may be either pre-assembled in the pipe, assembled during the pumping of the fluid propellant or after pumping is complete.

The step of pumping liquid propellant material into the pipe includes displacing any other fluid inside the pipe until the propellant fluid fills the pipe. Pumping of fluid propellant may continue until both the inside of the pipe and some or all of the annular space between the pipe and the wellbore is filled. In this case, the weakened portions of the pipe will have been pre-perforated.

The step of igniting the propellant material may be performed by igniting the propellant material simultaneously along the entire length of the pipe or it may be ignited at discrete points.

The step of collecting formation fluid from the formation through the pipe may include the step of using a pump to assist with the pumping of fluids to or from the wellbore. The pump may be located at the outlet end of the pipe either before or after the combustion process occurs and may suitably be a mechanical or electrically powered pump.

The present invention combines the method of stimulating and completing wellbores using high pressure gas produced in a pipe suitable for enabling fluid to be pumped to or from the wellbore by combustion of propellant materials containing fuel and oxidizer to pressurize the strata surrounding the wellbore causing fractures to form which aid in flow of fluids to and from the wellbore.

BRIEF DESCRIPTION OF THE DRAWINGS

To assist in understanding the invention, the preferred embodiments will now be described with reference to the following figures in which.

DETAILED DESCRIPTION

Figure 1:
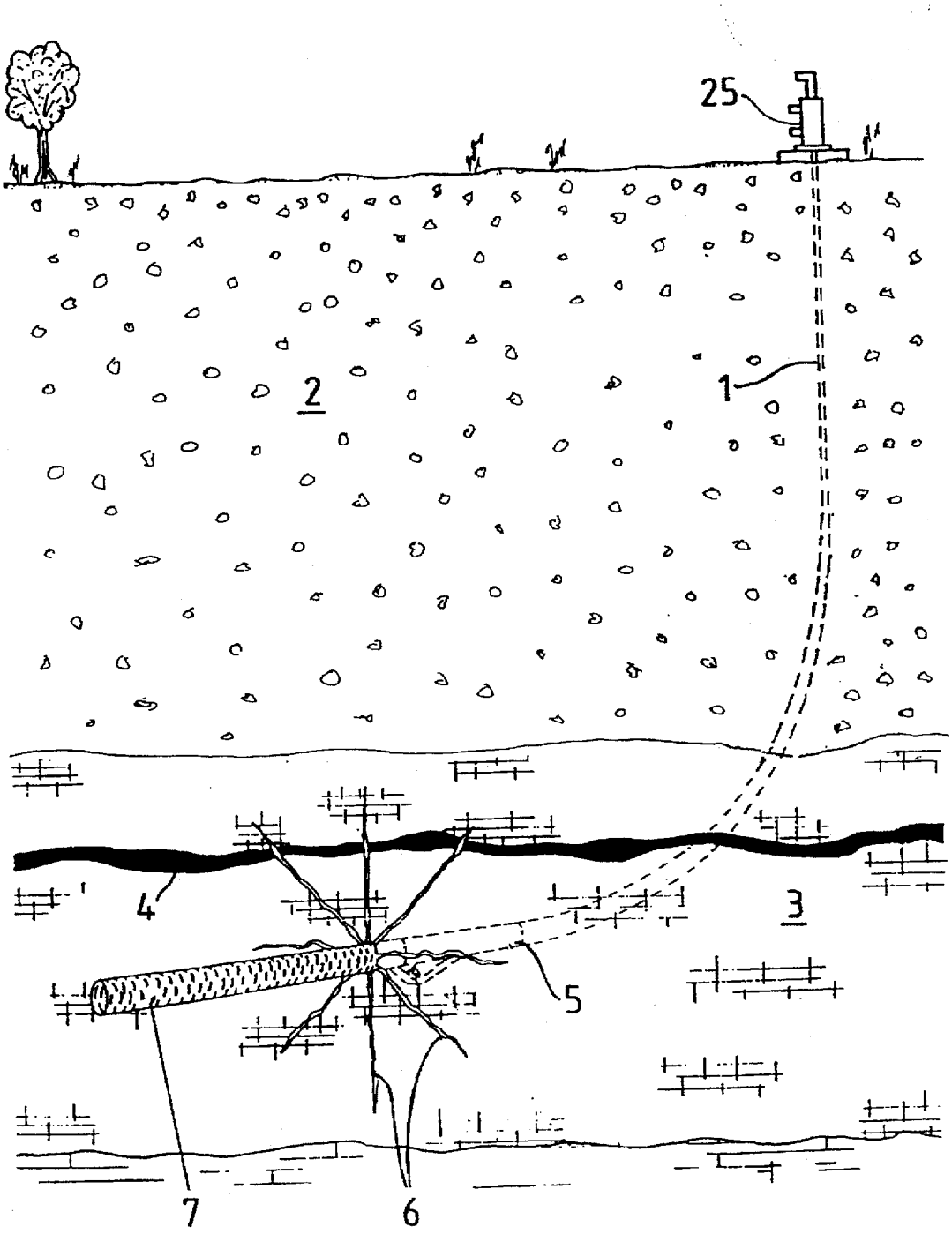
FIG. 1 is a schematic view of a horizontal oil or gas producing well showing the placement of a well stimulation and completion device.

In the drawings, like reference numerals refer to like parts. Referring to FIG. 1, there is shown a well 1 drilled vertically through non-productive formations 2, into a productive formation 3. The productive formation 3 contains a horizontal coal seam 4. The well is drilled directionally so as to include a horizontal section 5 which runs within the productive formation 3 for an extended distance. In some cases the length of the horizontal section of the well 1 may be two kilometers or more. For effective collection of fluid from the productive formation 3 it is desirable to fracture the formation 3 directionally as indicated by fractures, such as 6, in FIG. 1. This can be achieved by running into the wellbore 1 a wellbore stimulation and completion device 7.

Figure 2:
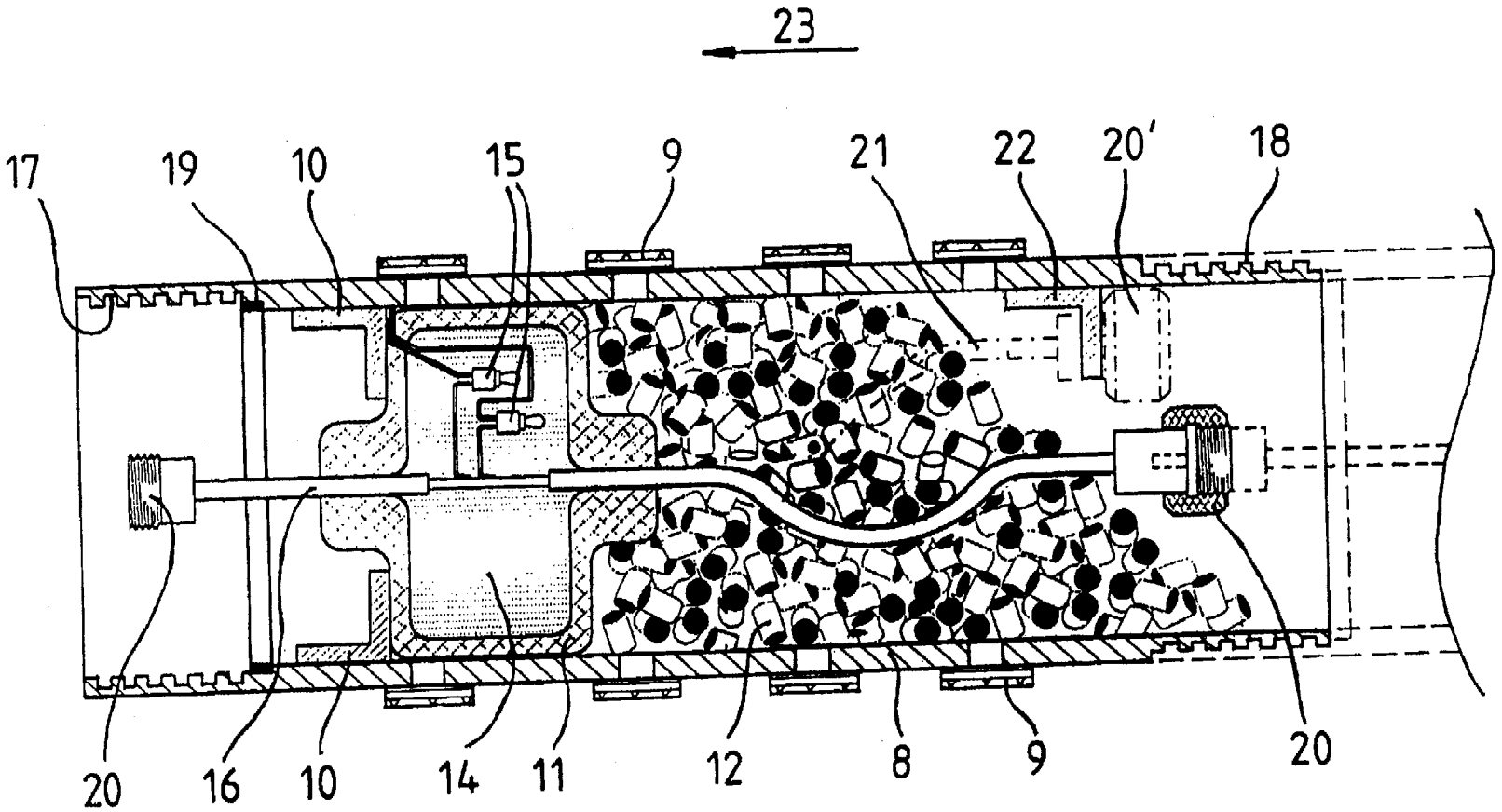
FIG. 2 is a cross-section of the wellbore stimulation and completion device of FIG. 1.

The device 7 is shown in detail in the cross-sectional view of FIG. 2. The device 7 comprises a pipe 8 with a number of weakened portions, such as 9. A pair of tabs 10 support an igniter case 11. The tabs 10 and igniter case 11 are of combustible material that is consumed during combustion of the propellant material 12.

Figure 3B:
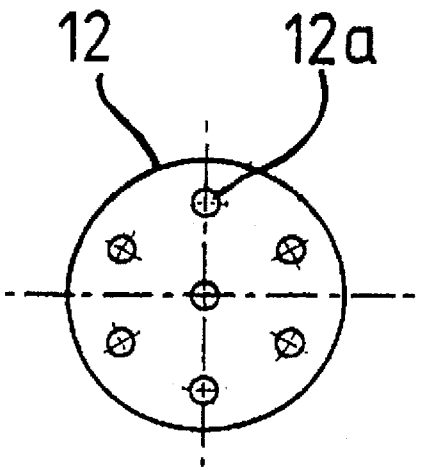
FIG. 3*b* is an end view of the propellant material of FIG. 3*a;*
Figure 3A:
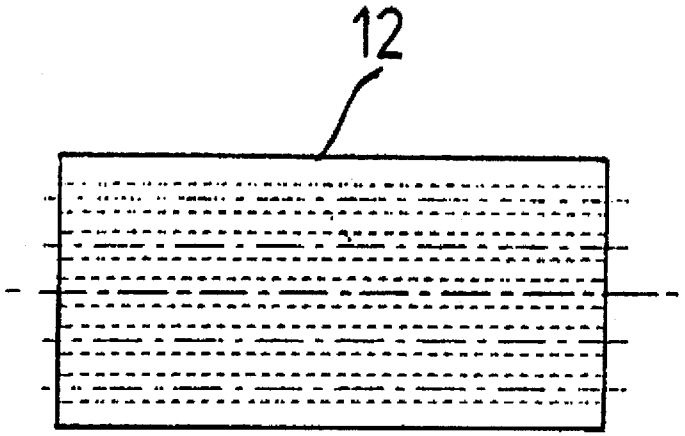
FIG. 3*a* is a side view of one form of propellant material.
Figure 4:
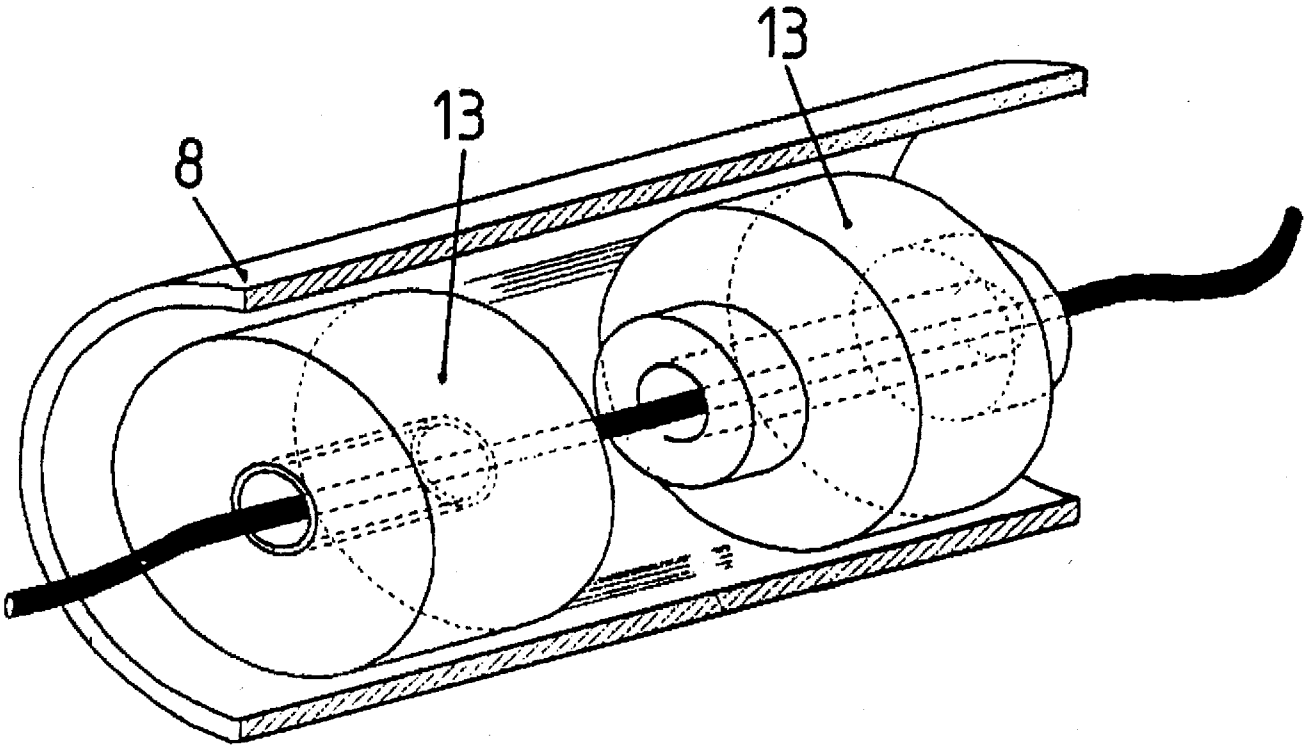
FIG. 4 is a schematic of an alternative form of propellant material.

The propellant material 12 is shown in more detail in FIGS. 3*a* and 3*b* as a perforated right circular cylinder. The typical dimensions are 10 millimeter diameter by 15 millimeters long with 1 millimeter diameter perforations 12*a*. The propellant may also be in the form of a single large grain 13 as depicted conceptually in FIG. 4.

The propellant material consists of fuel and oxidizers. The propellant ballistic properties are selected and the propellant shape is optimised to give a combustion pressure over time response appropriate to the wellbore strata.

In selecting an appropriate propellant material, consideration should be given to selecting an appropriate burning rate pressure exponent material. Neutral or positive exponent materials are generally available. Negative exponent materials are more attractive since they enable a constant pressure to be supplied.

The igniter case 11 is filled with pyrotechnic material 14. A suitable pyrotechnic material is 25% Boron and 75% Potassium Nitrate. The pyrotechnic material 14 may be in powder or pellet form. The igniter case 11, typically cellulose nitrate, also contains one or more initiators 15. The initiators 15 may be electric match heads, electric fuseheads, optical fibre nodes or other suitable initiation means. In the preferred embodiment the initiators 15 are shown as a pair of electric fuseheads connected in parallel. The shape of the igniter case is such as to retain loose propellant grains when the pipe is being screwed onto other pipe sections in the vertical position.

The electric circuit to fire the initiators 15 is made by cable 16 and the case of the pipe 8. The cable 16 is an insulated conducting wire with a steel or copper core forming a single return circuit with the steel pipe 8. If a plastic (or non-conducting) pipe is used a second cable (not shown) must be supplied to complete the circuit.

The device 7 is made in a number of sections. Each section is essentially identical having the structure described above. The sections are joined together as the device is run into the wellbore. In the preferred embodiment connection of sections is by complimentary threaded portions 17 and 18. To prevent fluid entering the pipe 8 through the join a sealing means 19, typically a Teflon ring (or equivalent), is provided. The cable 16 is joined by connectors 20.

The connectors 20 are of a locking type to provide secure connection between segments of the cable 16. This allows the cable to be drawn out of the device 7 after combustion of the propellant. As mentioned above, the igniter case 11 and tabs 3 are combustible so once the cable 16 is drawn from the device the internal of the pipe 8 is clean and suitable for the collection of fluid from the productive formation.

As can be seen at 21 the cable 16 is provided with a degree of slack to allow for the screwing together of adjacent sections of pipe 8. For convenience, a further consumable tab 22 is provided as a shipping tab to hold the connector 20' during transport and loading of the propellant 12. It is also convenient to provide shipping caps (not shown) in each end of a section of the device 7 to prevent contamination or damage during transport.

The first section of the device 7 to run into the wellbore differs slightly from the remainder of the sections in that it has a cap to prevent fluid and debris from entering the pipe 8. If the fuseheads are connected in series, there will also be an electrical connection from the cable 16 to the pipe 8 to complete the circuit.

The last section of device 7 may also differ from the other sections in that a termination is made enabling electrical connection of the cable 16 to an insulated cable running to a firing box located at the surface. The device 7 will only be used in the productive formation, the remainder of the wellbore may have conventional completion pipe and will normally be grouted and cased by prior art techniques.

The device 7 is run into the wellbore in the direction of arrow 23.

Figure 5:
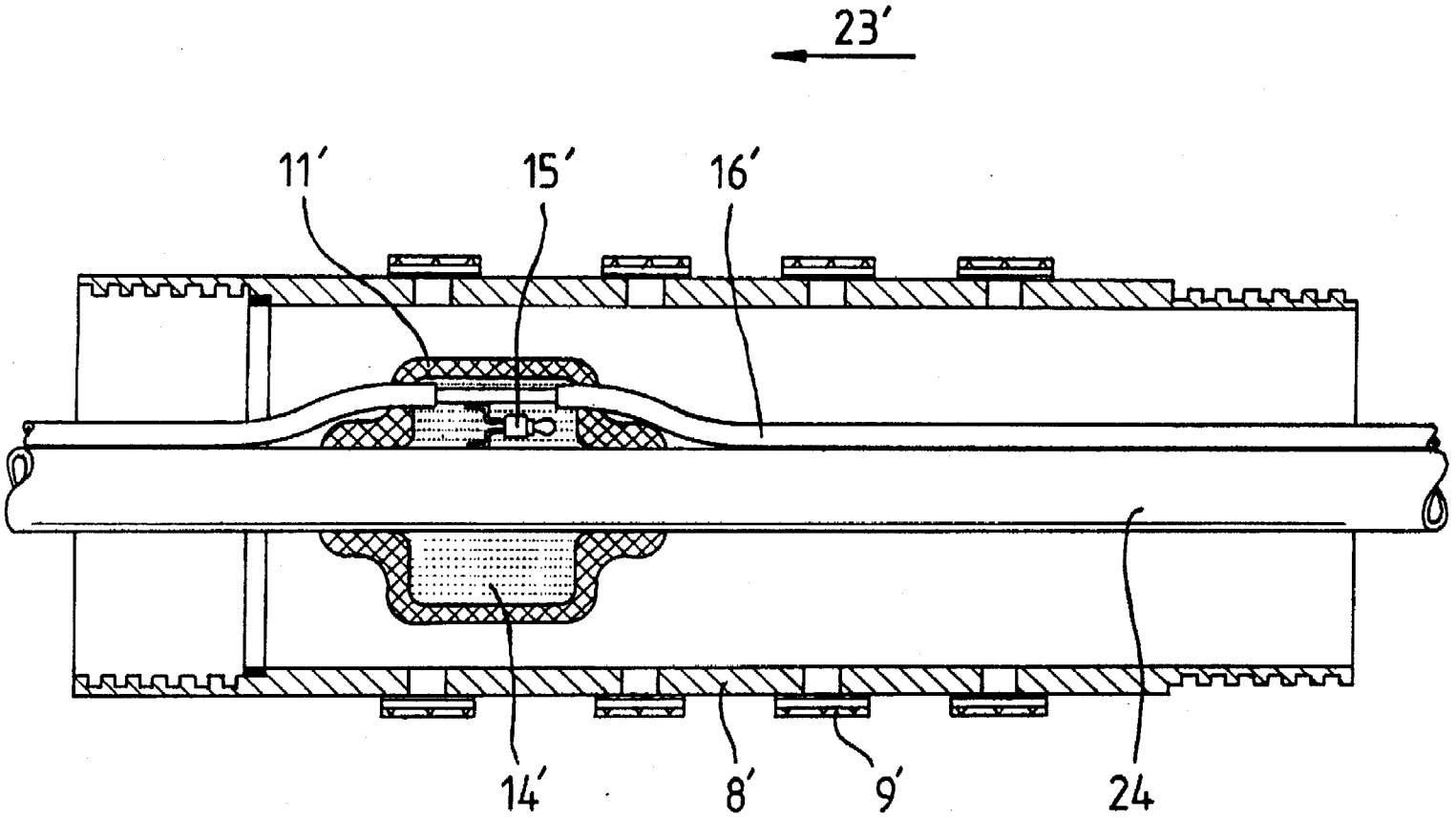
FIG. 5 is a schematic of an alternative embodiment of a wellbore stimulation and completion device.

An alternative embodiment of the device 7 is shown in FIG. 5. As mentioned above the propellant can be loaded to the device 7 after the device 7 has been run into the wellbore 1. In this embodiment the preferred propellant is liquid which is pumped into the device 7 through tube 24. The pipe 8' and slots 9' have the same structure as in the first embodiment. The igniter case 11' has a similar structure but is adhesively attached to the tube 24. A cable 16' makes a single circuit return with the tube 24. An initiator means 15' sets off the pyrotechnic material 14'.

Once the pipe 8' has been positioned in the productive formation the tube 24 is inserted through the pipe 8' and liquid propellant is pumped into the pipe 8' by pump 25 (shown in FIG. 1). The liquid propellant will normally be contained within the pipe 8' although it may be permitted to fill the surrounding wellbore. This can be facilitated by providing a conventional flap valve at the end of the first section of pipe. In this embodiment it may be acceptable for the weakened portions 9 to be openings. Any fluid that enters the pipe through the openings will be forced out during filling of the pipe with the liquid propellant.

The structure of the weakened portions 9 and 9' is shown in more detail in FIGS. **6*a* and 6*b* in which there are a number of slots 27 cut into the pipe 26. A wire mesh 28 is laid over the slots 27. The mesh is formed from wires, such as 29, running parallel to the longitudinal axis of the pipe 26 and overlaying wires, such as 30, running transverse to the longitudinal axis of the pipe 26. The mesh 28 is covered by an epoxy 31. The epoxy 31 is consumed or displaced during combustion of the propellant material thus leaving the slots 27 open to the productive formation. The mesh 28 remains in place and prevents debris from entering the pipe 26 but allows fluid, such as oil or gas, to be collected by the pipe 26. The slots 27 are positioned around the pipe 26 so as to produce radial fracturing of the productive formation as indicated in FIG. 1**.

Figure 6B:
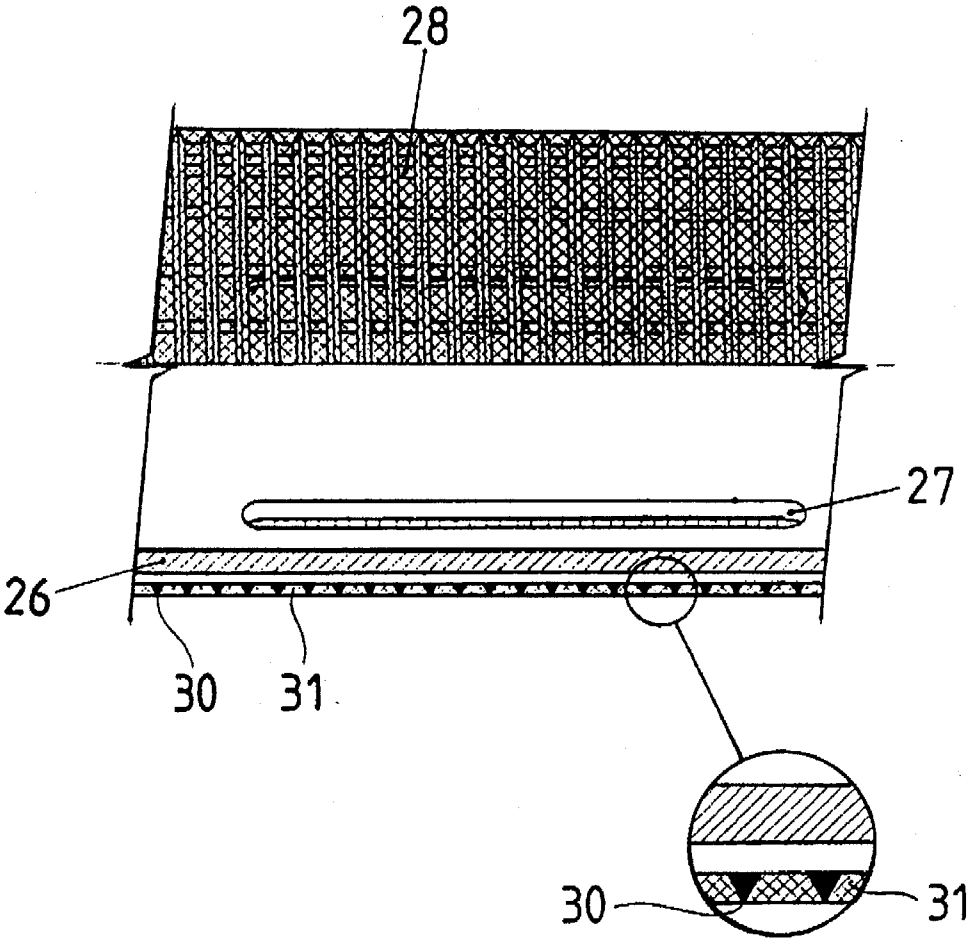
FIG. 6*b* is a half sectional side view of the weakened portion shown in FIG. 6*a;*
Figure 6A:
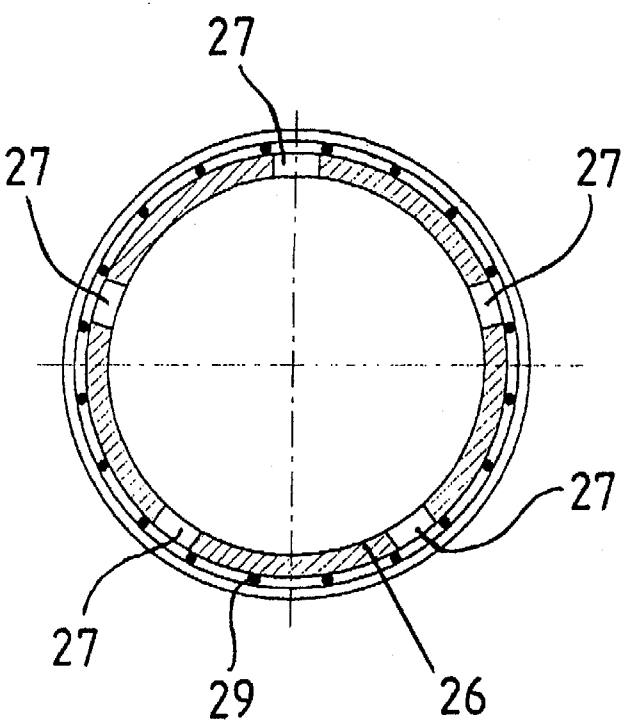
FIG. 6*a* is a cross-sectional end-view of a weakened portion of a wellbore stimulation and completion device.

Although slots and mesh have been shown in FIG. 6 as the preferred embodiment for the weakened portions it will be appreciated that this is only one possible embodiment. Other forms of mesh such as a turned thin metal tube or a metal shim could be used to cover the slots. The same effect can be achieved by weakening or thinning the pipe wall. The particular structure of the weakened portions may be modified to suit the nature of the productive formation being worked.

Figure 7:
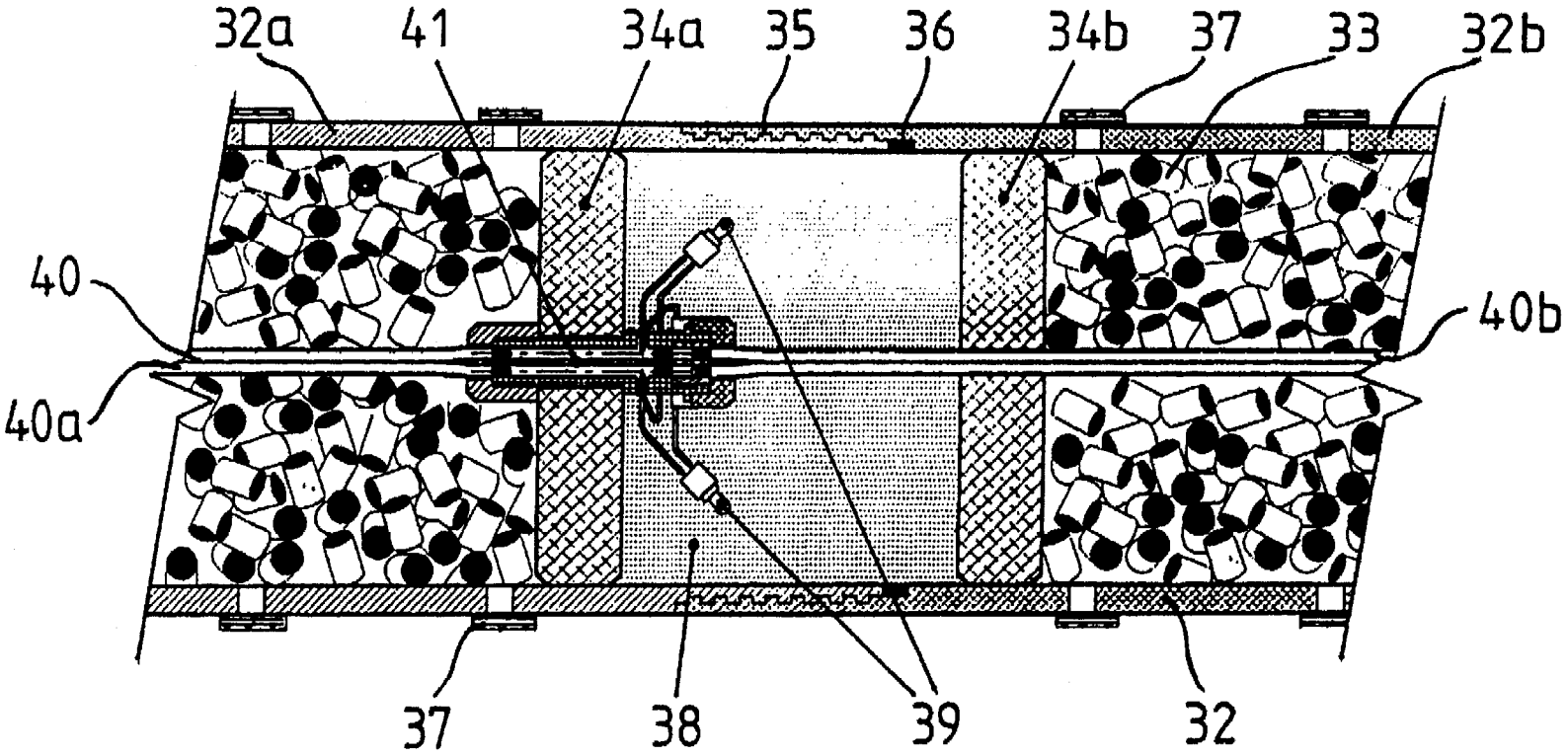
FIG. 7 is a cross-sectional view of a further embodiment of a wellbore stimulation and completion device.

A further embodiment of the wellbore stimulation and completion device is shown in FIG. 7. As with the embodiments of FIG. 2 and FIG. 5, the device comprises a pipe 32 filled with propellant material 33. An igniter case **34*a*, 34*b* is formed in two parts across the joint 35 between two sections 32*a* and 32*b* of the pipe 32. A teflon ring 36 provides a seal between the sections 32*a* and 32*b*. The pipe 32 has weakened portions such as 37**.

The pipe 32 is shipped with the propellant material 33 held in place by the igniter case halves **34*a* and 34*b*. Pyrotechnic material 38 is added and the two sections of pipe 32*a* and 32*b*** are joined.

The pyrotechnic material 38 is initiated by initiators 39. The current to the initiators is carried by two core cable 40. The cable **40*a* from pipe section 32*a* is connected to cable 40*b* from pipe section 32*b* by connector 41. In FIG. 7** the connector is shown as a bayonet fitting but any suitable two core connector will suffice.

Figure 8:
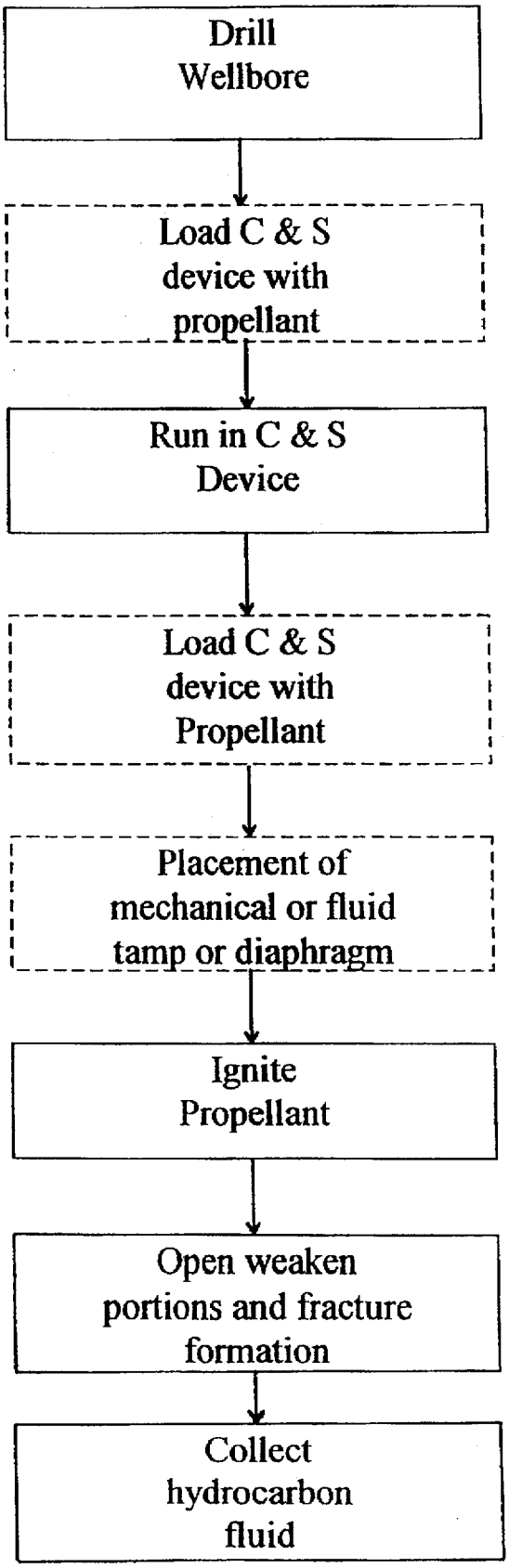
FIG. 8 is a flowchart of the steps of a method of stimulating and completing a wellbore.

The method of stimulating and completing a wellbore is depicted in FIG. 8. A wellbore 1 is drilled through non-productive formations 2 into productive formations 3 using known techniques. The well may be vertical, deviated or horizontal so that an extended portion of the wellbore 1 is located in a productive formation 3. A stimulation and completion device 7 is loaded with propellant material and ignition means. The loading step may occur above ground prior to running in the device 7 or below ground after the device 7 has been run in. The flowchart of FIG. 8 shows the loading step in two dotted locations to indicate that it can occur at either time. If the device 7 is loaded with propellant material above ground the propellant material will normally be solid. If the device 7 is loaded with propellant material below ground the propellant material will normally be liquid. In either case the device 7 is run into the wellbore 1.

Once the device 7 is in place in the productive formation a mechanical tamp (such as an expanding packer) may be placed in the wellbore (as indicated by the dashed box) and the propellant material is ignited by any suitable method. Alternatively, gas pressure from combustion can be maintained in the pipe by a fluid tamp. A diaphragm can be fitted to the termination fitting to prevent the tamp from flooding or entering the pipe section containing propellant before combustion commences. The diaphragm is so designed that it can withstand the pressure of the tamp but fails under the much higher pressure created by combustion.

The preferred method of ignition is by electric initiation although detonating cord or laser ignition by optical fibers would also be effective. Ignition of the propellant material results in a rapid production of gaseous combustion products which build pressure within the confines of the pipe. The weakened portions of the pipe give way under the pressure thereby opening the pipe to the productive formation. The escaping combustion products are directed into the productive formation thereby fracturing the strata surrounding the wellbore and improving the flow of fluids to or from the wellbore. Material remaining after combustion of the igniters and propellant is minimized to prevent unburnt debris from causing blockages in the pipe or pumps.

Oil and gas in the formation are collected in the pipe. The fractures in the formation aid in the collection by concentrating the flow of fluid towards the pipe and through the opened weakened portions.

By the use of this device a wellbore may be stimulated and completed in the same operation. The wellbore can be of any length and can be uncased. The device can be used in both horizontal or vertical wells. The slotted pipe facilitates the injection or loading of propellant material and after combustion prevents the collapse of uncased wellbores, screens out solid materials when pumping from the hole and enables distribution of material into surrounding strata when pumping into the hole. Furthermore, the entire productive length of the formation can be stimulated in a single operation compared with prior art techniques in which the formation must be stimulated in a series of relatively short sections.

Throughout the specification the aim has been to describe the preferred embodiments of the invention without limiting the invention to any one embodiment or specific collection of features.

We claim:

1. A device for the stimulation and completion of a wellbore in a subterranean formation comprising:

a wellbore casing section having a plurality of weakened portions penetratable to leave apertures in a sidewall of said wellbore casing section, said wellbore casing being adapted for coupling to other wellbore casings;

a propellant material contained within said wellbore casing section so as to be run into the wellbore with said wellbore casing section, said propellant material producing expanding gaseous combustion products when ignited, for penetrating the weakened portions of said wellbore casing section and producing apertures in the sidewall thereof; and one or more igniter means fixed in said wellbore casing section for igniting said propellant material; said wellbore casing section being suitable, after combustion, for remaining in said wellbore and for enabling formation fluid to be pumped into or from the wellbore via said apertures.

2. The device of claim 1 wherein the weakened portions comprise an aperture in said wellbore casing section covered by a sealing matrix.

3. The device of claim 2 wherein the sealing matrix comprises a wire mesh and filler, said filler being removable by the high pressure gaseous combustion products but said wire mesh remains over the apertures.

4. The device of claim 2 wherein the sealing matrix comprises a wire mesh and filler, said wire mesh being of an appropriate structure to permit easy passage of fluid but to resist ingress to the wellbore casing section of non-fluid material from the formation.

5. The device of claim 1 wherein said propellant material is a solid material contained within said wellbore casing section by a consumable material fixed therein, said consumable material being consumed as a result of the combustion of said propellant.

6. A method of stimulating and completing a wellbore including the steps of:

positioning a wellbore casing section having weakened portions and containing a propellant material in a wellbore at a productive formation;

igniting the propellant material in said wellbore casing section to produce expanding gaseous combustion products to cause a perforation of said wallbore casing section at the weakened portions and fracturing of the surrounding formation; and collecting formation fluid from the formation through said wellbore casing section for production thereof, wherein the wellbore casing section remains in the wellbore and formation fluid enters said wellbore casing section through the perforated weakened portions.

7. The method of claim 6 wherein the step of positioning said wellbore casing section in a productive formation further includes the steps of running said wellbore casing section into the wellbore until said wellbore casing section is at the productive formation, placing an igniter means in said wellbore casing section and pumping a liquid propellant material into said wellbore casing section.

8. The method of claim 6 in which the propellant material is ignited simultaneously along the entire length of said wellbore casing section.

9. The method of claim 6 in which the propellant material is ignited simultaneously at multiple discrete points along confines of said wellbore casing section.

10. The method of claim 6 further including the step of providing a tamp in said wellbore casing section to contain the gaseous combustion products.

11. The method of claim 6 further including loading said wellbore casing section with said propellant, attaching said wellbore casing section to a casing, and positioning said casing and attached wellbore casing section with propellant into said wellbore.

12. The method of claim 6 further including containing said propellant in said wellbore casing section by a consumable material fixed within said wellbore casing section, wherein said consumable material is consumed during combustion of said propellant and need not be retrieved from said wellbore casing section to collect and remove the formation fluid therefrom.

13. A device for the stimulation and completion of a well bore in a subterranean formation comprising:

a pipe having a plurality of weakened portions penetratable to leave apertures in the pipe;

a liquid propellant post-loaded into said pipe, said liquid propellant material producing expanding gaseous combustion products when ignited, for penetrating the weakened portions of said pipe;

one or more igniter means in said pipe for igniting said liquid propellant material; and said pipe being suitable, after combustion, for enabling fluid to be pumped into or from the wellbore.

14. The device of claim 13 wherein said pipe is threadably fastened to a casing and remains in said wellbore after said stimulation and completion.

* * * * *